US005628846A

United States Patent [19]

Huss et al.

[11] Patent Number: 5,628,846

[45] Date of Patent: May 13, 1997

[54] METHOD AND APPARATUS FOR FORMING PREFABRICATED SELF-FORMING SELF-ADHERING PULL BOW AND PULL BOW FORMED THEREBY

[75] Inventors: Charles P. Huss, Stillwater; Arthur L. Fry, Maplewood; Steven R. Leseman, Lexington, all of Minn.

[73] Assignee: Minnesota Mining and Manufacturing Company, St. Paul, Minn.

[21] Appl. No.: 442,811

[22] Filed: May 17, 1995

Related U.S. Application Data

[62] Division of Ser. No. 31,560, Mar. 15, 1993, Pat. No. 5,468,523.

[51] Int. Cl.[6] ..... D04D 7/10

[52] U.S. Cl. ..... 156/70; 223/46; 428/5; 428/101

[58] Field of Search ..... 428/4, 5, 101; 28/147; 156/70; 223/46

[56] References Cited

U.S. PATENT DOCUMENTS

| | | | |
|---|---|---|---|
| 1,276,731 | 8/1918 | Crowell | 428/258 |
| 2,072,095 | 3/1937 | Cohn | 428/193 |
| 2,153,310 | 4/1939 | Newman | 24/17 R |
| 2,248,317 | 7/1941 | Cleef | 206/447 |
| 2,278,673 | 4/1942 | Savada et al. | 428/42.3 |
| 2,450,083 | 9/1948 | Donaldson | 428/40.1 |
| 2,586,039 | 2/1952 | Heggedal | 428/39 X |
| 2,626,883 | 1/1953 | Boese | 428/4 X |
| 2,641,562 | 6/1953 | Chartrand et al. | 428/42.1 |
| 2,880,862 | 4/1959 | Sermattei | 428/41.3 |
| 3,011,988 | 12/1961 | Luedke et al. | 428/514 X |
| 3,241,662 | 3/1966 | Robinson et al. | 428/343 |
| 3,256,129 | 6/1966 | Wallerstein et al. | 428/5 |
| 3,447,954 | 6/1969 | Lohse | 427/208.2 |
| 3,468,744 | 9/1969 | Reinhart | 428/41.6 X |
| 3,475,259 | 10/1969 | Meserole | 428/189 |
| 3,479,243 | 11/1969 | Doig | 428/5 |
| 3,632,464 | 1/1972 | Grikis | 428/4 |
| 3,637,455 | 1/1972 | Pearson et al. | 428/4 |
| 3,691,140 | 9/1972 | Silver | 526/240 |
| 3,857,731 | 12/1974 | Merrill, Jr. et al. | 428/314.4 |
| 3,922,407 | 11/1975 | Nimmo, Jr. et al. | 428/5 |
| 3,922,464 | 11/1975 | Silver et al. | 428/355 |
| 3,954,212 | 5/1976 | Bolis | 223/46 |
| 4,138,527 | 2/1979 | Malek | 428/425.1 X |
| 4,151,319 | 4/1979 | Sackoff et al. | 428/41.4 |
| 4,166,152 | 8/1979 | Baker et al. | 428/522 |
| 4,329,382 | 5/1982 | Truskolaski et al. | 428/4 |
| 4,390,576 | 6/1983 | Hutter, III | 428/40.1 |
| 4,421,817 | 12/1983 | Pina et al. | 428/207 |
| 4,476,168 | 10/1984 | Aoyama | 428/4 |
| 4,515,837 | 5/1985 | Cheng | 428/4 |
| 4,576,854 | 3/1986 | Kurahashi | 428/204 |
| 4,585,676 | 4/1986 | De Smet et al. | 428/5 |
| 4,634,612 | 1/1987 | Nelson et al. | 428/4 |
| 4,670,012 | 6/1987 | Johnson | 604/390 |
| 4,680,210 | 7/1987 | Corcoran | 428/42.3 |
| 4,684,552 | 8/1987 | LaBrosse et al. | 428/4 |
| 4,696,854 | 9/1987 | Ethier | 428/287 |
| 4,708,907 | 11/1987 | Flutti et al. | 428/352 |
| 4,713,267 | 12/1987 | Truskolaski | 428/4 |
| 4,724,175 | 2/1988 | LaBrosse et al. | 428/4 |
| 4,725,461 | 2/1988 | Masui | 428/4 |

(List continued on next page.)

FOREIGN PATENT DOCUMENTS

| | | |
|---|---|---|
| 0248113 | 12/1987 | European Pat. Off. . |
| 0439941 | 8/1991 | European Pat. Off. . |
| 0443263 | 8/1991 | European Pat. Off. . |
| 218171 | 9/1989 | New Zealand . |

*Primary Examiner*—Henry F. Epstein

*Attorney, Agent, or Firm*—Gary L. Griswold; Walter N. Kirn; James J. Trussell

[57] ABSTRACT

A self-forming self-adhering pull bow having a pressure sensitive adhesive coating on facing sides of the drawstrings. After the bow is formed, the drawstrings are separated to enable the pressure sensitive adhesive coated sides of the drawstrings to be applied to the object to adhere the bow to the object.

10 Claims, 7 Drawing Sheets

U.S. PATENT DOCUMENTS

| | | | |
|---|---|---|---|
| 4,735,837 | 4/1988 | Miyasaka et al. | 428/40.2 |
| 4,770,320 | 9/1988 | Miles et al. | 221/33 |
| 4,781,306 | 11/1988 | Smith | 221/33 |
| 4,812,338 | 3/1989 | Masui | 428/4 |
| 4,826,712 | 5/1989 | Theno | 428/4 |
| 4,842,303 | 6/1989 | Molenda | 281/38 |
| 4,907,825 | 3/1990 | Miles et al. | 281/51 |
| 4,915,996 | 4/1990 | Curry | 428/40.9 |
| 4,968,562 | 11/1990 | Delgado | 428/402 |
| 4,988,567 | 1/1991 | Delgado | 428/402 |
| 4,994,322 | 2/1991 | Delgado et al. | 428/343 |
| 5,015,520 | 5/1991 | Vaccari | 428/215 |
| 5,026,578 | 6/1991 | Iname | 428/4 |
| 5,032,436 | 7/1991 | Gustafson | 428/14 |
| 5,045,569 | 9/1991 | Delgado | 521/60 |
| 5,053,436 | 10/1991 | Delgado | 521/64 |
| 5,073,457 | 12/1991 | Blackwell | 428/484 |
| 5,114,761 | 5/1992 | Doherty | 428/4 |
| 5,118,750 | 6/1992 | Silver et al. | 524/462 |
| 5,153,041 | 10/1992 | Clements et al. | 428/41.5 |
| 5,192,612 | 3/1993 | Otter et al. | 428/355 |
| 5,194,299 | 3/1993 | Fry | 427/208.6 |
| 5,244,701 | 9/1993 | Saigo et al. | 428/4 |
| 5,468,523 | 11/1995 | Huss et al. | 428/5 |

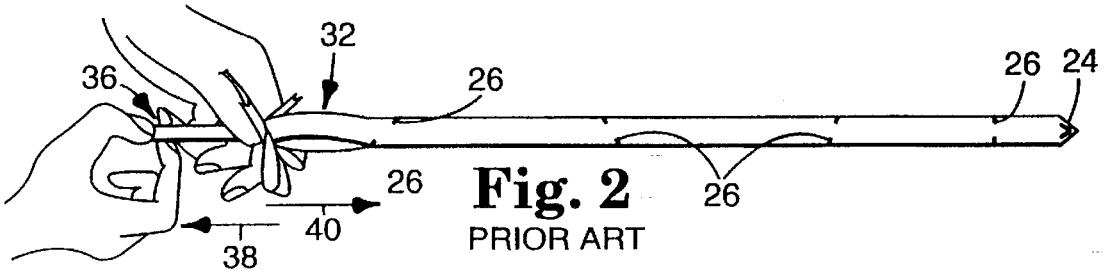
Fig. 2
PRIOR ART
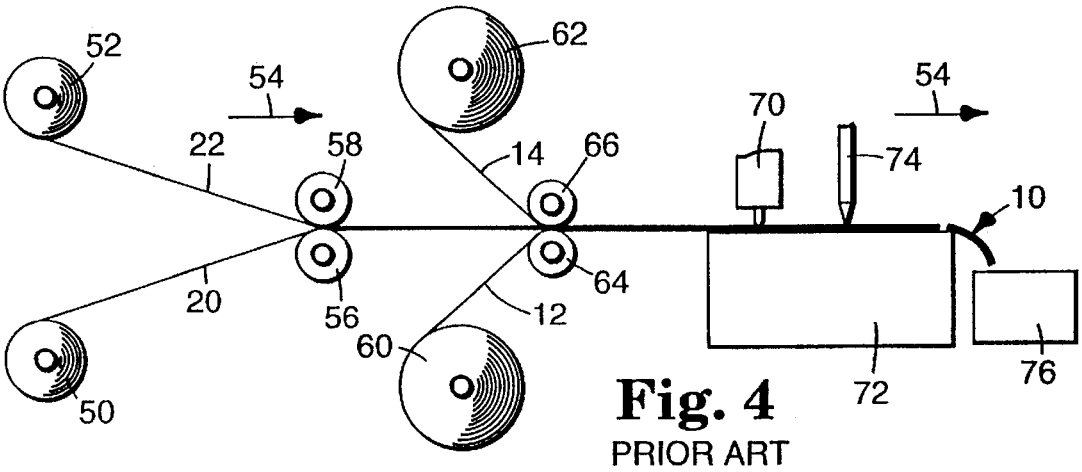
Fig. 4
PRIOR ART
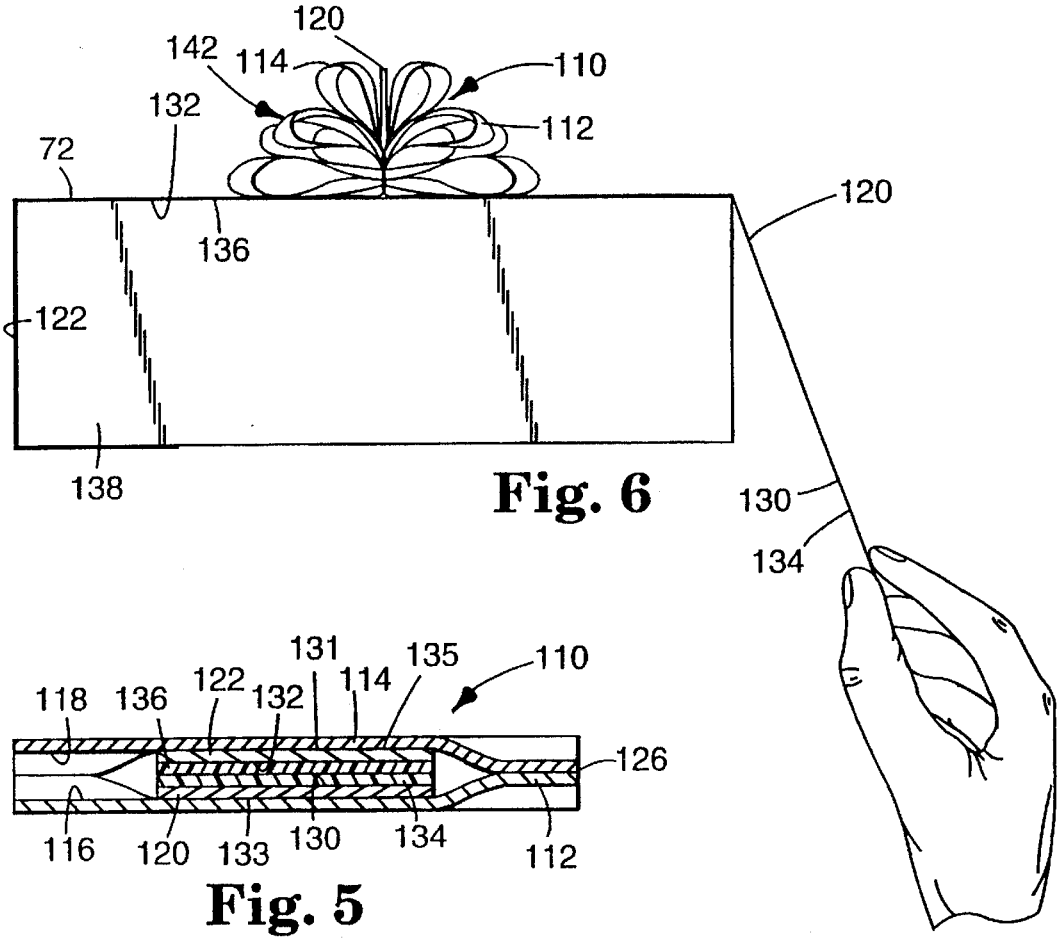
Fig. 6
Fig. 5

METHOD AND APPARATUS FOR FORMING PREFABRICATED SELF-FORMING SELF-ADHERING PULL BOW AND PULL BOW FORMED THEREBY

This is a division of application Ser. No. 08/031,560 filed Mar. 15, 1993 and now U.S. Pat. No. 5,468,523.

FIELD OF THE INVENTION

This invention relates generally to prefabricated self-forming pull bows.

BACKGROUND OF THE INVENTION

Designs for self-forming prefabricated pull bows are known in the art, such as in U.S. Pat. Nos. 3,637,455; 3,954,212; 4,329,382; 4,476,168 and 4,515,837, the contents of which are incorporated herein by reference. As shown in FIGS. 1 and 1A, such conventional prefabricated pull bows 10 have included two ribbon bands 12, 14 with aligned facing major surfaces 16, 18, respectively. A pair of drawstrings 20,22 are interposed between the facing major surfaces 16, 18 of the ribbon bands.

First ends of the drawstrings 20,22 are bonded to each other and to the ribbon bands 12,14 adjacent one end of the ribbon bands (as at 24). The ribbon bands are also bonded to each other at spaced paired locations 26 on either side of the drawstrings.

Pairs of the bonded locations 26 on the ribbon bands on opposing sides of the drawstrings form "fold lines" 30 that act to form loops (as at 32 in FIGS. 2 and 3) in the ribbon bands when the second, opposite ends 34, 36 of the drawstrings 20,22 are grasped and pulled in direction 38 while the ribbon bands are held stationary or pushed in the opposite direction 40 (as shown in FIG. 2). When the fold lines and resulting loops are gathered adjacent first ends (at 24 and as shown in FIG. 3), a bow portion 42 is fully formed and the drawstrings extend therefrom.

Referring now again to FIG. 1, if a fold line 30 is transverse to the length of the ribbon bands, (as at 30*a* in FIG. 1) the resulting loops 32 are aligned with each other and the ribbon bands, resulting in bows available from the Minnesota Mining and Manufacturing Co. of St. Paul, Minn. under the trademark "Tiara". In U.S. Pat. No. 4,476,168, issued to Aoyama, fold lines 30 (as at 30*b* in FIG. 1) are disclosed that were inclined with respect to the ribbon bands. This resulted in bows being formed having with loops that may be inclined with respect to the drawstrings. Bows having inclined fold lines are available from the Minnesota Mining and Manufacturing Co. of St. Paul, Minn. under the trademarks "Pom" and "Regal" as shown in FIG. 4. Of course, other alternate bow designs may be devised and are known in the art by arranging the number, angle and position of the various fold lines.

FIG. 4 illustrates one apparatus and method for constructing a conventional prefabricated self-forming pull bow as Shown in FIGS. 1, 1A, 2 and 3. Drawstring webs 20 and 22 are drawn from supply rolls 50 and 52, respectively generally in direction 54 and pass through aligned nip rollers 56 and 58. Ribbon bands 12 and 14 are drawn from supply rolls 60 and 62, respectively and pass though aligned nip rollers 64 and 66, with drawstrings 20 and 22 interposed between the ribbon bands. At least three bonding members 70 are provided (only one of which is shown in FIG. 4). One is generally aligned with each longitudinal edge of the ribbon bands, and another is transversely positioned at a medial location.

The bonding members 70 are periodically actuated in a manner known in the art to form bonded locations 26 along the longitudinal edges of the ribbon bands on other side of the drawstrings, or at a medial location 24 to establish the first ends of the bows, as shown in FIG. 1, supported by platform 72. The location and spacing of the bonded location may be predetermined to construct a bow having the desired size and formation, as previously discussed.

Severing means are provided in the form of knife 74 to sever each prefabricated self-forming pull bow from the bonded continuous web. Preferably, the knife forms a chevron shaped division (as shown in FIGS. 1 and 3) between the respective first ends and the second ends of sequential bows. Each severed bow 10 is sequentially received within receptacle 76.

Once the bows are formed, as shown in FIG. 3, the extended drawstrings 20,22 may be tied together about an object (not shown), such as a package, to secure the bow in place. Alternatively, segments of pressure sensitive adhesive tape may be applied to the drawstrings to secure the drawstrings, and thus the bow, to the object. However, neither of these approaches are completely satisfactory.

If the ends of the drawstrings are tied together, the bow may not be adequately secured to the object. Furthermore, the bow may not be conveniently removable without cutting the drawstrings, preventing reuse. Using segments of pressure sensitive adhesive tape while holding the bow in position on an object may be likewise not convenient. Furthermore, if it is desired to reposition the bow on the object, the tape may damage the exterior of the object upon removal, such as if the object is a package with a wrapping paper exterior.

It is also known from U.S. Pat. No. 4,826,712, and U.S. Pat. No. 2,278,673, to provide a decorative ribbon having a coating of pressure sensitive adhesive on a surface thereof. The '673 patent discloses that a pressure sensitive adhesive may be utilized that is removable from a surface, and the '712 patent discloses that a pressure sensitive adhesive may be utilized that is repositionable with respect to the surface.

However, neither of these patents suggests the incorporation of such pressure sensitive adhesive coated ribbons in facing contact in the construction of a self-forming pull bow, nor do they suggest that pressure sensitive adhesive coated drawstrings, placed in adhesive-to-adhesive contact, may be bonded to each other through the layers of pressure sensitive adhesive.

SUMMARY OF THE INVENTION

The present invention provides a self-forming pull bow for application to a package. The bow includes a pair of aligned ribbon bands having, each having a first width, a first end, and a second end, with facing major surfaces. The bow also includes a pair of aligned drawstrings, each having a second width less than the first width of the ribbon bands, a first end and a second end. The ribbon bands and the drawstrings are bonded together at the first ends thereof. The ribbon bands are bonded together at a plurality of spaced paired locations on opposite sides of the drawstrings, so that the drawstrings are constrained between the ribbon bands but unbonded thereto other than at the first ends. Each of the pairs of spaced bonded locations on opposite sides of the drawstrings form a fold line extending across the ribbon bands, about which the ribbon bands will fold to form loops when a bow is formed by gathering the bonded areas adjacent the second ends. At least a portion of the facing major surfaces of the drawstrings have a layer of a pressure sensitive adhesive coated thereon so as to adhere the drawstrings to each other, wherein the drawstrings may be separated and the exposed layers of pressure sensitive adhesive applied to an object to adhere the bow to the object.

In one embodiment, the bow further including means for separating the facing surfaces of the drawstrings.

The present invention further includes a method for constructing the self-forming self-adhering pull bow for application to an object. The method includes the steps of: (a) providing a pair of ribbon band segments, each having a first width, a major surface, a first end and a second end; (b) providing a pair of drawstring segments, each having a second width less than the first width of the ribbon band segments, a major surface, a first end and a second end, with at least a portion of the major surfaces of the drawstrings being coated with a layer of pressure sensitive adhesive; (c) aligning the pressure sensitive adhesive coated major surfaces of the drawstrings; (d) adhering the drawstrings to each other by placing the pressure sensitive adhesive layers in contact with each other; (e) aligning the major surfaces of the ribbon bands; (f) interposing the reciprocally adhered drawstrings between the aligned ribbon bands; (g) bonding the first ends of the drawstrings and the ribbon bands together; and (h) bonding the ribbon bands together in paired locations on opposite sides of the drawstrings to form fold lines.

The method may further include the additional steps of: (i) forming loops in the ribbon bands between the fold lines by shifting the second ends of the ribbon bands adjacent the first ends of the ribbon bands, thereby collecting the fold lines adjacent the first ends of the ribbon bands and forming the bow; (j) separating the pressure sensitive adhesive coated surfaces of the drawstrings; and (k) applying the pressure sensitive adhesive coated surfaces of the separated drawstrings to an object to adhere the bow to the object.

The method of the present invention may also include a pressure sensitive adhesive that is a repositionable pressure sensitive adhesive, and further include the step of (l) removing the drawstrings from the object without damage to the object or to the bow. The method for constructing a bow utilizing a repositionable pressure sensitive adhesive may further include the steps of: (m) repositioning the bow with respect to the object; and, (n) readhering the drawstrings of the bow to the object.

Alternative methods of applying a layer of pressure sensitive adhesive to the facing surfaces of the drawstrings include spraying an aerosol dispersed adhesive, applying a pressure sensitive adhesive transfer tape or a double coated pressure sensitive adhesive tape to the drawstrings.

BRIEF DESCRIPTION OF THE DRAWINGS

The present invention will be more thoroughly described with reference to the accompanying drawing in which like numbers refer to like parts in the several views, and wherein:

FIG. 2 is plan view of the conventional prefabricated self-forming pull bow of FIG. 1 partially formed into a bow;

FIG. 4 is a schematic representation of an apparatus that may be used to construct the conventional prefabricated self-forming pull bow of FIGS. 1 and 2;

FIG. 5 is a cross-sectional view of a prefabricated self-forming pull bow according to the present invention having facing surfaces of the drawstrings coated with a pressure sensitive adhesive;

FIG. 6 is a front view of the prefabricated self-forming pull bow of FIG. 5 being applied to an object;

DETAILED DESCRIPTION OF THE INVENTION

Figure 1:
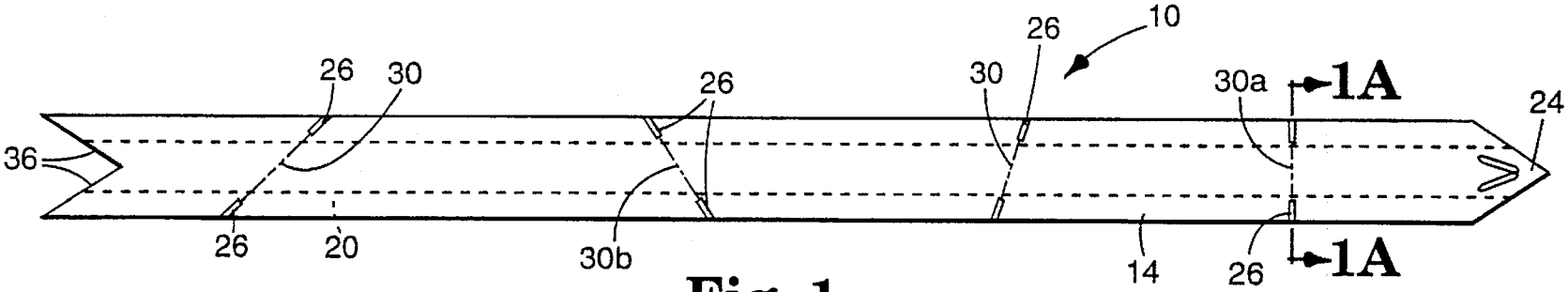
Fig. 1 PRIOR ART
FIG. 1 is a plan view of a prefabricated self-forming pull bow according to the prior art prior to forming the bow.
Figure 3:
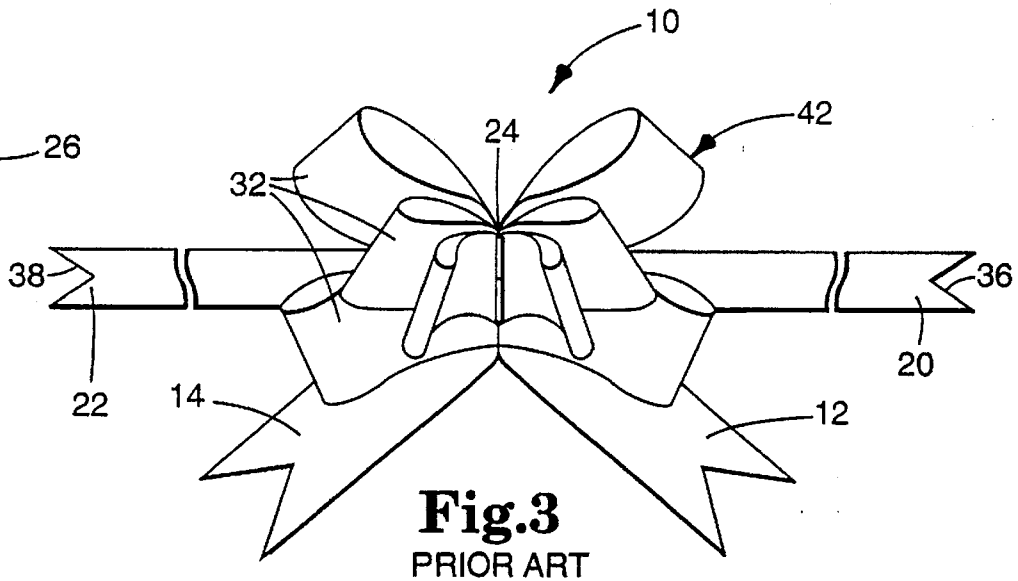
Fig.3 PRIOR ART
FIG. 3 is plan view of the conventional prefabricated self-forming pull bow of FIGS. 1 and 2 formed into a bow.
Figure 1A:
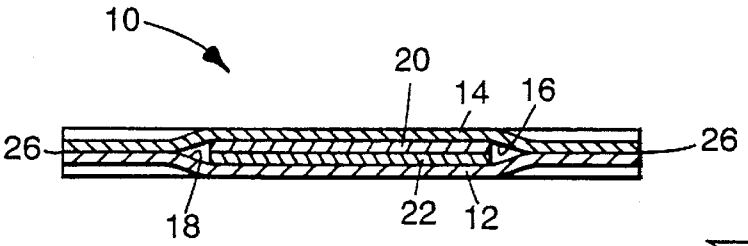
Fig. 1A PRIOR ART
FIG. 1A is a cross-sectional view along plane 1A—1A of the conventional pull bow of FIG. 1.

Referring now to FIG. 5, there is shown in cross-section a prefabricated self-forming self-adhering pull bow 110 according to the present invention. The structure of the pull bow 110 of FIG. 5 is generally the same as that shown in FIGS. 1, 1A, 2 and 3, and includes a pair of ribbon bands 112 and 114 having facing major surfaces 116, 118, respectively, and a pair of drawstrings 120 and 122. For the purposes of this invention, the term "ribbon" shall include any woven, non-woven or film material formed into a flexible narrow strip.

Although the ribbon bands and drawstrings could be constructed of any suitable ribbon material, the following is a non-exclusive list of the preferred materials: polymeric films such a polyethylene, polypropylene, foamed polypropylene, paper, styrene, cellulose acetate, polyester, nylon and the like; woven and nonwoven fabrics having a bondable surface on one of the major surfaces; and decorative sheet materials such as those disclosed in U.S. Pat. Nos. 4,634,612 and 4,713,257, the contents of which are incorporated herein by reference. Ribbon materials suitable for use in constructing the self-forming self-adhering pull bows of the present invention are available from the Minnesota Mining and Manufacturing Co. of St. Paul, Minn. under the trademarks "Sasheen" or "Decosheen."

Most preferably, the ribbon materials are pigmented polypropylene, foamed pigmented polypropylene, and the aforementioned decorative sheet materials. The decorative sheet materials have a thermally bondable base layer, and bonded to the base layer is at least a monolayer of substantially parallel, continuous multifilament yarns.

The thermally bondable base layer can be a film, a woven sheet, or a nonwoven sheet. Preferably the thermally bondable base layer is a nonwoven sheet of thermally bondable polymeric binder fibers (hereinafter referred to as binder fibers). The thermally bondable binder fibers provide an autogenously interbonded staple fiber base that can be heat bonded to itself and thermally bonded to the yarns. The term "heat bonded" is synonymous with heat sealability wherein the base layer can be fused to various substrates such as the filament yarns by such heat bonding means as heating rolls, heat staking, heat guns, sonic sealers, untrasonic welders, lasers, and laminators or the like.

The binder fibers can be any polymeric fiber-forming material having at least an outer portion that is thermally bondable. It is preferred that the thermally bondable portion of the fibers melt in the range of about 110° C. to about 200° C., and more preferably, in the range of about 110° C. to about 125° C. Examples of such fibers include polyolefins, polyester, polyamides, or combinations thereof. Preferred binder fibers are of the core-and-sheath type, having a sheath which melts to form bonds at the desired temperature, and a core which melts at a temperature at least 30° C. above the melting temperature of the sheath.

The binder fibers can be continuous filament fibers, staple fibers, or a combination thereof. Continuous filament fibers can be formed into nonwoven sheets by direct deposition of the filaments from spinnarets, and staple fibers can be formed on a carding machine, a "Garnett" machine or a "Rando-Webber" in well known processes.

Staple fibers, when used, preferably have a length of about 0.6 cm to 15 cm, and more preferably from about 2.5 to 7.5 cm. The binder fibers preferably have a denier in the range of 0.5 to 10 denier, and more preferably 1 to 6 denier.

At least 50 percent by weight of the base layer should be binder fibers to provide sufficient bonding within the base layer and for sufficient bonding to the filament yarns. The base layer may contain other fibrous non-thermobonding materials to increase the softness and suppleness of the base layer. Such materials include polymeric staple fibers such as polyester, nylon, polypropylene, acetate, rayon, and acrylic, as well as natural fibers such as cotton and wood pulp.

When non-thermobonding fibers are included in the base layer, it is preferred that a thermobonding resin be added in amounts up to about 20 percent by weight of the base layer. Examples of such resins include acrylic resins, vinyl acrylic resins, styrene acrylic resins, ethylene vinyl acetate resins, and polyvinyl acetate resins. The resins can be applied known coating methods including roll coating, dipping, and spray coating The continuous multifilament yarns are thermally adhered to the base layer and are substantially parallel and aligned along the length of the sheet to substantially cover one surface of the base layer. The multifilament yarns can be any cellulosic or non-cellulosic fiber-forming material such as polyester, polyamide, polypropylene, and acetate. The yarns formed from thermoplastic materials preferably have a melt temperature at least 30° C. higher than the thermobonding portion of the binder fiber. Uncrimped and untwisted yarns are preferred when the maximum sheen is desired.

The yarns preferably have a denier/filament in the range of about 1 to 10, and more preferably 3 to 5. The yarns are typically supplied through condensing combs on a warp beam and brought into contact with the base layer in a heated nip to laminate or bond the yarns to the base layer. The bonded sheet is then optionally sized and dyed to provide a desired aesthetic appearance. The dye may be incorporated into the sizing solution. Typical sizing agents include acrylic resins and vinyl resins which are dispersed in water and/or a solvent. The term "dye" refers to agents used to impart color to a substrate and includes dyes and pigments. Water-based dyes are preferred, as organic solvents are environmentally undesirable.

Figure 7:
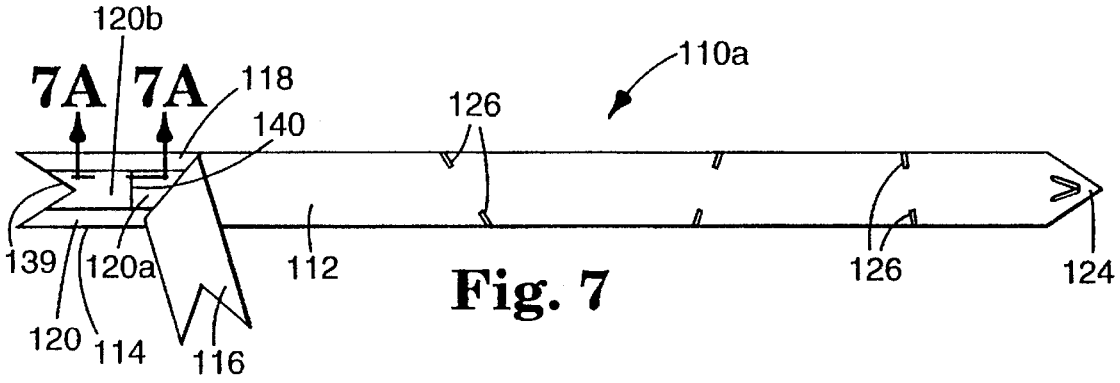
FIG. 7 is a plan view of a prefabricated self-forming pull bow according to the present invention and including means for separating the drawstrings.

Referring now particularly to FIGS. 5 and 7, the drawstrings 120,122 and the ribbon bands 112,114 are bonded together at first end 124. For purposes of this invention, the term "bonded" includes any arrangement for securing the ribbon bands to each other and to the drawstrings with sufficient strength as to withstand the forces applied during the process of forming the bow, and includes, but is not limited to: heat staking, ultrasonic bonding, applying adhesive, sewing, mechanical clips, staples or the like. In the preferred embodiment of the invention, the bow ribbon and drawstrings are bonded by ultrasonic bonding. The ribbon bands are bonded to each other on either side of the drawstrings at spaced intervals along longitudinal edges (as at 126 in FIG. 5 as previously described with respect to FIG. 1) to form various fold lines (not shown in FIG. 7).

Facing major surfaces 130 and 132 of drawstrings 120 and 122, respectively, are each coated with a layer 134, 136, respectively, of a layer pressure sensitive adhesive along at least a portion, and preferably the entire length and width of the facing surfaces of the drawstrings. The layers of pressure sensitive adhesive 134,136 may be of any suitable type of pressure sensitive adhesive that permits the drawstrings to be conveniently separated after the bow is formed, and then applied to an object. Such adhesives include rubber resin pressure sensitive adhesives, acrylate pressure sensitive adhesives, synthetic block copolymers, and the like.

Preferably, the pressure sensitive adhesive is a repositionable adhesive and enables the drawstrings to be removed from a surface without damage to the surface or the drawstrings. Such "repositionable" pressure sensitive adhesives are manufactured by Minnesota Mining and Manufacturing Company of St. Paul, Minn., and applied to products marketed under the "Post-it" trademark. Examples of repositionable adhesives include the microsphere pressure sensitive adhesives disclosed in U.S. Pat. Nos. 3,691,140; 3,857,731; 4,166,152; 4,968,562; 5,045,569; and 5,118,570; and EP 439,941; the block copolymer adhesive disclosed in EP 443,263, and the acrylate composition disclosed in U.S. Pat. No. 5,073,457; all incorporated herein by reference.

Most preferably, the adhesive is a repositionable discontinuous pressure sensitive adhesive such as a microsphere pressure sensitive adhesive. Such an adhesive may include solid microspheres, hollow microspheres or a combination thereof. The preferred repositionable pressure sensitive adhesive comprises about 5 to 50 percent by weight of microspheres in a solvent. The microspheres are solid, infusible, solvent-dispersible, solvent-insoluble pressure sensitive microsphere made from a copolymer of from 90 to 99.5 percent by weight of at least one alkyl acrylate ester, such as 2-ehtylhexyl acrylate, isooctyl acrylate, 2-methylbutyl acrylate, and the like; and about 10 to 0.5 percent by weight of maleic anhydride or at least one ionic co-monomer that is substantially oil-insoluble and water soluble, such as sodium methacrylate, ammonium acrylate, sodium acrylate, and the like.

The layers 134, 136 of pressure sensitive adhesive may be coated on the drawstrings utilizing any suitable coating process such as extrusion, die or transfer roll coating or, in the alternative, a pressure sensitive adhesive may be sprayed such as from an aerosol container or applied as an adhesive transfer tape (such as the No. 951 pressure sensitive adhesive tape available from the Minnesota Mining and Manufacturing Company of St. Paul, Minn.) or double coated pressure sensitive adhesive tape (such as the 665 and 9424 double coated pressure sensitive adhesive tapes available from the Minnesota Mining and Manufacturing Company of St. Paul, Minn.) adhered to the facing surfaces of the drawstrings. The 665 and 9424 pressure sensitive adhesive tapes are examples of tapes that include different pressure sensitive adhesives coated on opposite sides of the tape backing. The two adhesives have a relatively low level of adhesion to each other, and enables the tapes to be provided in roll form without a release liner interposed between the facing layers of the different adhesives. This enables the bow of the present invention to be constructed without a liner interposed between the facing surfaces of the drawstrings if the tape is applied to the drawstrings with different adhesives facing each other, as described in regard to another embodiment of the present invention shown in FIG. 13. However, the different adhesives adhere aggressively to a surface to which the drawstrings are applied. Of course, the different pressure sensitive adhesives may be coated directly on the facing surfaces of the drawstrings with the advantages described above.

The drawstrings 120,122 may also be coated with a layer of primer disposed between the pressure sensitive adhesive layers 134,136 and the surfaces 130,132, respectively, to enhance the adhesion of the pressure sensitive adhesive to the drawstring material. Useful primers include zinc oxide in a resin binder, as described in U.S. Pat. No. 4,822,670, the contents of which are incorporated herein by reference, chlorinated polyolefins, and phenolic resins. Corona treatment may also be applied to surfaces 130,132 of the drawstrings to enhance adhesion of the adhesive to the ribbon material. The choice of the primer depends upon the material that the drawstrings are composed of and the pressure sensitive adhesive to be applied.

The drawstring material may also be coated with a layer (not shown) of a low adhesion backsizing material on the surfaces 131,133 opposite the pressure sensitive adhesive coated surfaces 130,132. Useful low adhesion backsizing materials include polyorganosiloxanes, fluorosilicones, epoxypolysiloxanes, and the like. Such low adhesion backsizing layers facilitate the winding of the pressure sensitive adhesive coated drawstring web into roll form, and subsequent unwinding in the construction of the self-forming self-adhering pull bow of the present invention, but otherwise does not affect the structure of operation of this invention.

In some cases, a protective coating may be used on the drawstrings to prevent the yarns from pulling away from the ribbon. Useful coatings include the acrylic terpolymers and tetrapolymers disclosed in U.S. Pat. No. 3,011,988, the contents of which are incorporated herein by reference.

The following examples serve to further illustrate the invention:

EXAMPLE 1

A web of ribbon material was constructed as described above. A nonwoven web, having 50% by weight polyester binder fiber (4 denier, 3.2 cm long "Melty" brand fiber available from Unitika, Ltd., Japan) and 50% by weight polyester fiber (Kodel brand 411 polyester fiber from Eastman Chemical Products, Inc.), was formed on a Garnett machine. The web weight was about 30 g/m$^2$.

The web was coated with an aqueous solution of an acrylate thermobonding resin (Rhoplex™P-376 available from Rohm & Haas Company) to a dry coating weight of about 7 g/m$^2$. The web was dried at 120° C. for about 45 seconds to form the base layer.

Acetate yarns (320 denier/90 filament/0 twist, type 3T-E000 bright, available from Celanese) were supplied from a warp beam through a comb at 16 ends per cm. The yarns were laminated to the base layer using a laminating drum at a temperature of 193° C. for a contact time of about 1 second and a laminating pressure of 14 kg/cm. The laminated sheet material was then passed through a sizing/dye bath. The bath was prepared by dispersing 22.5 parts Rhoplex HA-12 acrylic resin (available from Rohm & Haas) in 77.5 parts water. An antifoaming agent (Foamaster VL available from Henkel Company) was added at about 0.1 parts and the pH was adjusted to about 9 with ammonium hydroxide. The following coloring pigments, all available from Heucosperse, LTD, were added: 7.4 parts Heucosperse GS 5450, 0.5 part Heuocosperse YS 5340, and 0.1 part Heucosperse 5720. The sheet material was dried at 71° C. for about 20 seconds. The dry solids pick up was about 1.7 g/m$^2$. The dried sheet was passed over an anti-wrinkle slat, then over a first ironing drum steam heated to 93° C. and finally over a second ironing drum heated to the same temperature. The resulting sheet material had a lustrous satin-like appearance with a green color.

The ribbon material used for the drawstrings was prepared by coating the surfaces 130,132 containing the yarn with a protective coating made according to the process disclosed in U.S. Pat. No. 3,011,988, Example 1, having a monomer composition of 51% octadecyl acrylate, 25% acrylonitrile, 11% methyl acrylate, and 13% acrylic acid. The coating was coated to a dry weight of about 83.7 mg/200 cm$^2$. The base layer side was coated with a primer having 23 parts by weight zinc oxide, 6 parts vinyl chloride resin (VAGH from Union Carbide), and 71 parts of a 75:25 mixture of toluene and methylisobutyl ketone at a coating dry weight of about 84 mg/200 cm$^2$.

A repositionable microsphere pressure sensitive adhesive having a 98/2 composition of isooctyl acrylate/ammonium acrylate dispersed in heptane (prepared as disclosed in Example 6 of U.S. Pat. No. 3,691,140), was coated onto the primed surface at a dry coating weight of about 293 mg/200 cm$^2$.

The ribbon material was then slit into desired ribbon widths and self-forming self-adhering pull bows were formed as described above. The drawstrings of the self-forming self-adhering pull bows thus produced were separable from each other, and the drawstrings were repositionable on a paper substrate.

EXAMPLE 2

A ribbon material made from unoriented pigmented polypropylene was coated with an adhesive having 100 parts Kraton™ 1652 (available from Shell Chemical Corporation), 300 parts Wingtac Extra (available from the Goodyear Tire and Rubber Company), 20 parts "Polybutene 128" (from Chevron Chemical Company), 10 parts "Shellwax 100" paraffin wax (from Shell Chemical Company), and 2 parts "Ethanox 300" antioxidant (from Ethyl Corporation). The adhesive was dispersed in toluene (40% solids) and coated onto the ribbon at a coating weight of about 320 grams/200 square cm.

The ribbon material was then slit into desired ribbon widths and self-forming self-adhering pull bows were formed as described above. The drawstrings of the self-forming self-adhering pull bows thus produced were separable from each other, and the drawstrings were repositionable on a paper substrate.

In FIG. 6, an embodiment of the self-forming self-adhering pull bow has been formed with the structure previously described herein with respect to FIGS. 5 and 7 and the drawstrings 120,122 manually separated to expose the surfaces 130,132 coated with pressure sensitive adhesive 134,136. One drawstring 120 has been applied to an object 138 and the other drawstring 122 has been partially applied, with the formed bow 142 in a medial position on the object. The bow is thus securely adhered to the object, without requiring tying of the drawstrings or the application of extraneous pressure sensitive adhesive tape segments. If a non-permanent (e.g. repositionable) adhesive is utilized, the formed bow may be removed, repositioned and reapplied to the object without damage to the object or to the bow. Thus, the user of the bow is enabled to quickly and easily arrange or rearrange the bow on an object, such as a package covered with wrapping paper, until aesthetic concerns are satisfied.

It is possible to manually separate the facing surfaces 130 and 132 of the drawstrings 120,122 containing the layers of pressure sensitive adhesive 134,136. However, it is preferable to provide means to facilitate convenient separation of the reciprocally adhered pressure sensitive adhesive layers of the drawstrings after the bow portion 142 is formed in order to apply the exposed pressure sensitive adhesive layers 134,136 to a surface or object.

Figure 7A:
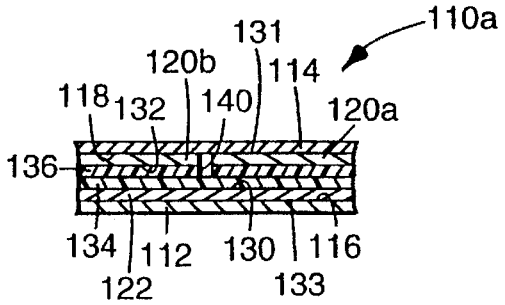
FIG. 7A is a cross-sectional view along plane 7A—7A of the prefabricated self-forming pull bow of FIG. 7.

One embodiment 110*a* of the prefabricated self-forming self-adhering pull bow of the present invention including separation means is illustrated in FIGS. 7 and 7A, wherein a weakened line 140 is formed in one of the drawstrings (drawstring 120 as illustrated). This divides drawstring 120 into two portions, a main portion 120*a* and a shorter portion 120*b* adjacent second ends (at 140) of the drawstrings. The weakened line 140 may take the form of a score line, a cut in the drawstring, a perforated line, or any other equivalent structure that enables one of the drawstring to be divided at the desired location. In the preferred embodiment of the invention, the weakened line takes the form of a cut through the thickness of the drawstring.

Separation of the drawstrings is accomplished by convexly flexing drawstring 120 to enable engagement with the end of main segment 120*a* of drawstring 120. The other portion 120*b* masks the underlying pressure sensitive adhesive layer of drawstring 120 and may also be grasped to separate the drawstrings, with segment 120*b* preferably being subsequently removed and disposed.

Figure 8:
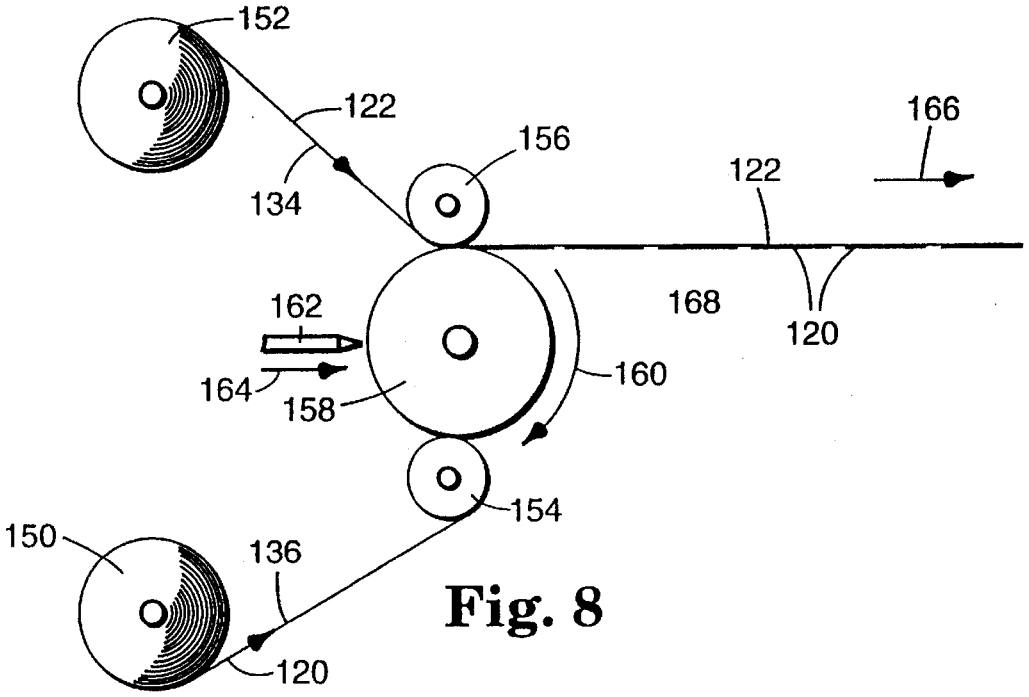
FIG. 8 is a schematic representation of an apparatus for constructing the drawstrings of the prefabricated self-forming pull bow of FIGS. 7 and 7A.

FIG. 8 illustrates an apparatus and a method for constructing a prefabricated self-forming self-adhering pull bow according to the embodiment shown in FIGS. 7 and 7A. A pair of continuous drawstring webs 120 and 122, each coated with a layer of pressure sensitive adhesive 134 and 136, as previously described, are supplied by supply rolls 150 and 152, respectively, to roller 158 rotating in direction 160. First nip roller 154 directs drawstring web 120 about roller 158 in rotational direction 160. Drawstring web 122 is brought into alignment and contact with drawstring 120 at second nip roller 156, with both pressure sensitive adhesive layers 134,136 facing each other so that the drawstrings are reciprocally adhered to each other and are conveyed in direction 166.

Formation of the weakened line is accomplished in the illustrated embodiment by knife 162 or the like positioned adjacent drawstring web 120 and is periodically actuated by a mechanism (not shown) to move in direction 164 into contact with drawstring 120 to form a transverse cut in the drawstring 120 at desired intervals. Roller 158 takes the form of a vacuum wheel along its peripheral surface, so that the severed drawstring web is conveyed and held in position in rotational direction 160 until the drawstring web 122 is encountered at nip roller 156. The combined drawstrings 120,122 are thereafter conveyed in direction 166 and subsequent formation of the pull bow in combination with ribbon bands (not shown) is as previously described in regard to FIG. 4.

Figure 9:
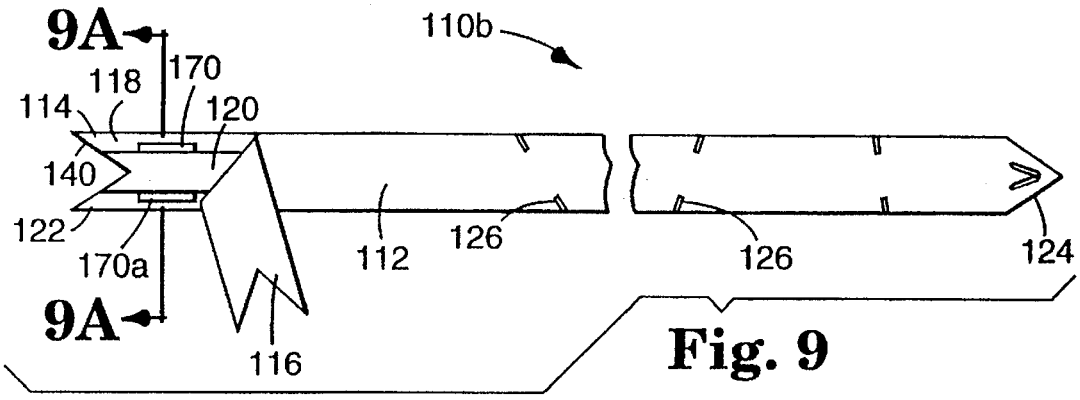
FIG. 9 is a plan view of an alternative embodiment of the present invention with a portion of one ribbon band folded back to expose an alternate means for separating the drawstrings.
Figure 9A:
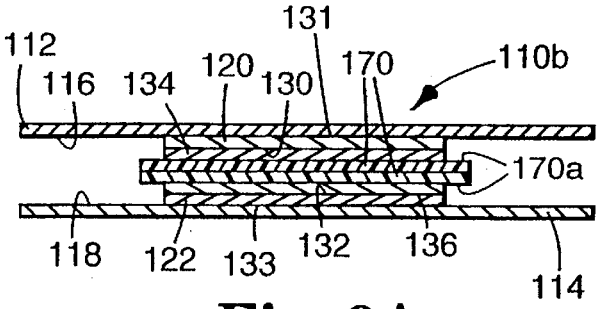
FIG. 9A is a cross-sectional view along plane 9A—9A of the prefabricated self-forming pull bow of FIG. 9.

FIGS. 9 and 9A illustrate another alternate embodiment 110*b* of the present invention in which a tab 170 is adhered to at least one and preferably a separate tab is adhered to both facing pressure sensitive adhesive layers 134 and 136 of the drawstrings 120 and 122. Each tab 170 includes a portion 170*a* that projects beyond the facing reciprocally adhered surfaces of the drawstrings. The projecting portions 170*a* of the tabs 170 may be grasped and pulled apart to separate the drawstrings.

Figure 10:
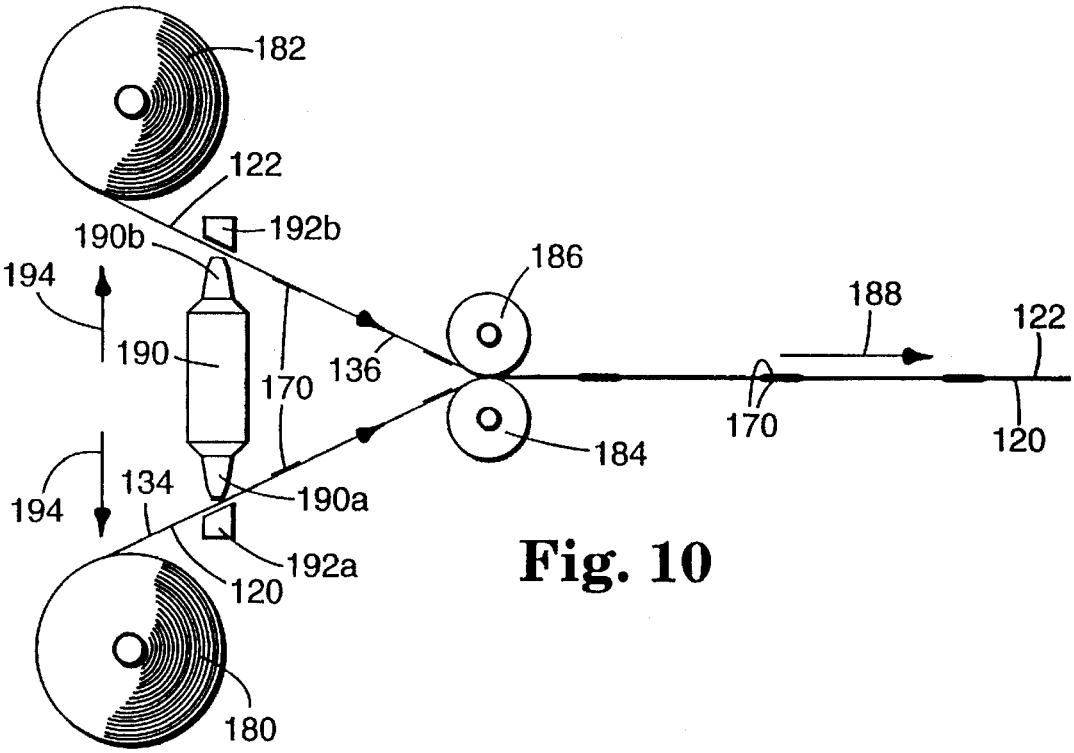
FIG. 10 is a schematic representation of an apparatus for constructing the drawstrings of the alternate embodiment of the present invention shown in FIG. 9.

FIG. 10 illustrates one embodiment of an apparatus and method for constructing the embodiment 110*b* of the present invention shown in FIGS. 9 and 9A. Drawstring webs 120 and 122 are drawn off of supply rolls 180 and 182, respectively. The drawstring webs 120,122 are brought together with their pressure sensitive adhesive coated sides 134,136 in contact at nip rollers 184 and 186 and thereafter are conveyed together in direction 188 for further construction of a prefabricated self-forming self-adhering pull bow in conjunction with ribbon bands (not shown) as previously hereinabove described.

Means are provided to apply the tabs 170 to the pressure sensitive adhesive layers 134,136 of the drawstring webs 120,122. In the illustrated embodiment, the applicator means takes the form of tab applicator 190 situated in between drawstring webs 120 and 122. The tab applicator 190 includes tabbing members 190*a* and 190*b* and aligned platens 192*a* and 192*b*. The tabbing members 190*a*, 190*b* are periodically actuated to apply a tab 170 to the drawstring webs, reinforced by the platens 192*a* and 192*b*. Preferably, the tabs 170 on both drawstrings are aligned when the drawstring webs 120,122 are reciprocally adhered.

Figure 11:
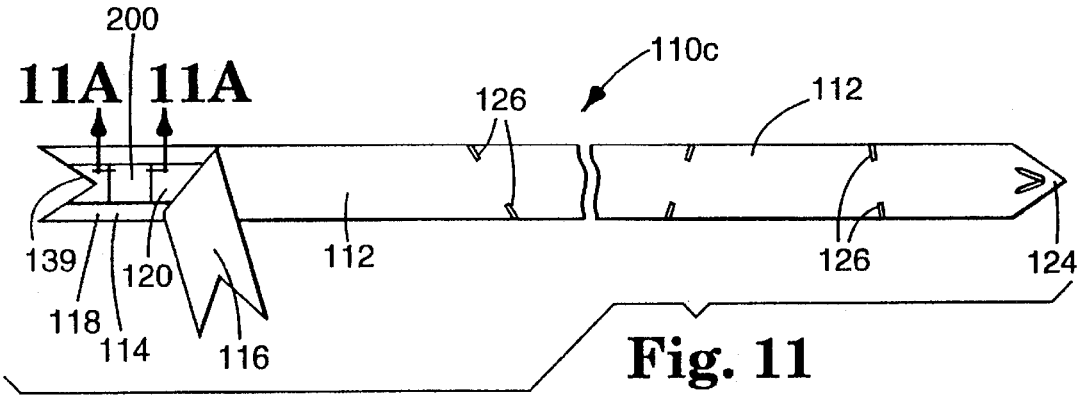
FIG. 11 is a plan view of another alternative embodiment of the present invention with a portion of one ribbon band folded back to expose another alternate means for separating the drawstrings.
Figure 11A:
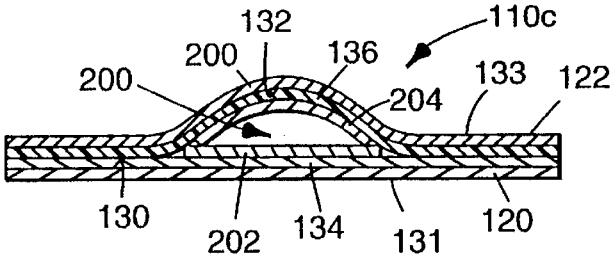
FIG. 11A is a cross-sectional view along plane 11A—11A of the prefabricated self-forming pull bow of FIG. 11.

Yet another alternate embodiment 110*c* of the prefabricated self-forming self-adhering pull bow of the present invention is shown in FIGS. 11 and 11A. Prefabricated self-forming self-adhering pull bow 110*c* includes loop 200 adjacent second ends (at 140) of the drawstrings 120 and 122. The loop 200 facilitates manual engagement and separation of the drawstrings. The portion of layers of pressure sensitive adhesive 134 and 136 of the drawstrings may, if desired, be covered with a release liner segments 202 and 204, respectively. Alternately, the portions of the drawstrings forming loop 200 may be constructed without a pressure sensitive adhesive coating on aligned segments of major surfaces 130, 132.

Figure 12:
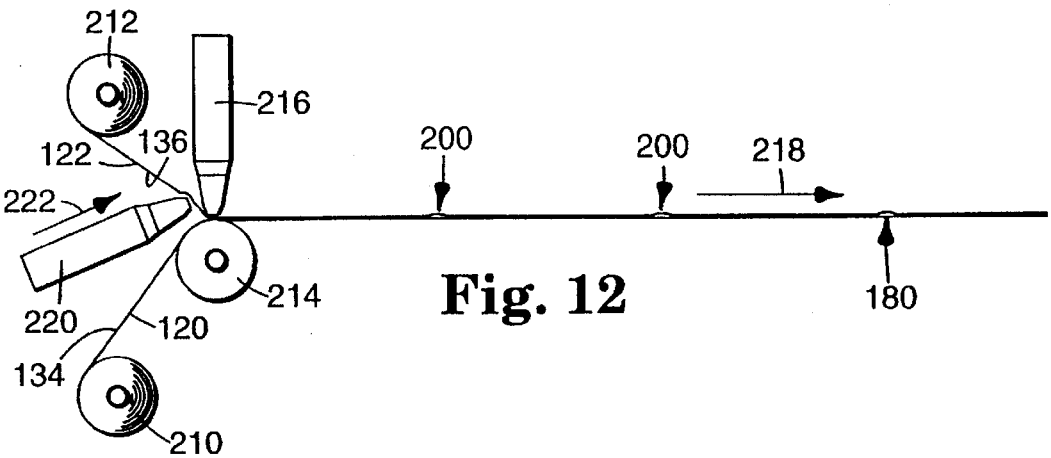
FIG. 12 is a schematic representation of a process for forming the drawstrings of the alternate embodiment of the present invention shown in FIGS. 11 and 11A.

FIG. 12 illustrates one embodiment of apparatus and a method for constructing the prefabricated self-forming self-adhering pull bow 110*c* of FIGS. 11 and 11A. Drawstring webs 120 and 122 are pulled from supply rolls 210 and 212, respectively, with respective pressure sensitive adhesive layers 134, 136 facing each other. Loop forming member 220 is periodically actuated by a mechanism (not shown) to extend in direction 222 against drawstring web 122. The drawstrings 120, 122 are brought together at nip roller 214 and brushed together by platen 216 to reciprocally adhere into a projecting "tab" (not shown). The reciprocally adhered drawstrings are conveyed in direction 218. Loops 200 are thus periodically formed in the reciprocally adhered drawstrings webs conveyed in direction 218. This embodiment utilizes a greater length of drawstring 122 than drawstring 120 in forming the prefabricated self-forming self-adhering pull bow 110*c* of the present invention.

In the illustrated embodiment, liners 202,204 may be applied to aligned positions on facing pressure sensitive adhesive coated surfaces 130,132 of the drawstrings webs at loop 200 in any convenient manner known in the art to facilitate separation of the drawstrings starting at the loop without forming a tab.

Figure 15:
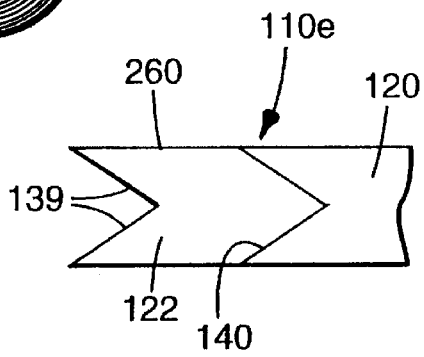
FIG. 15 is a magnified partial view of the drawstrings of yet another alternate embodiment of the present invention, wherein the drawstrings have differing lengths.

Alternatively, once the loop has been formed in drawstring 122, the drawstring may be severed at the loop in order to form drawstring 122 with a length from area 124 that is longer than the length of drawstring 120 (as in FIG. 15).

Figure 13:
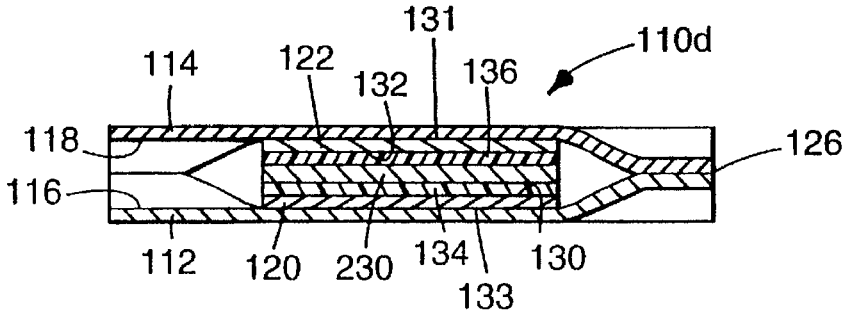
FIG. 13 is a cross-sectional view of yet another alternative embodiment of the present invention with another alternate means for separating the drawstrings.

FIG. 13 illustrates another alternate embodiment 110*d* of the present invention in which a release liner 230 is interposed between the pressure sensitive adhesive layers 134, 136 of the drawstrings 120 and 122. Preferably, the release liner 230 is coextensive with the pressure sensitive adhesive layers of the drawstrings and facilitates the separation of the drawstrings. Release liner 230 is distinguished from tab 170 in FIGS. 9 and 9A in that the release liner is intended to be removed from the drawstrings 120 and 122 and discarded prior to use of the prefabricated self-forming self-adhering pull bow. Due to the difficulty that may be encountered in ultrasonic welding and heat bonding the drawstrings 120, 122 and ribbon bands 112,114 through liner 230, other bonding means may be employed, such as sewing, mechanical staples, clips or the like (not shown). Alternatively, the liner 230 may be interposed in discrete lengths, rather than continuously, between the drawstrings to avoid the point 124 at which the drawstrings and ribbon bands are bonded to each other.

Figure 14:
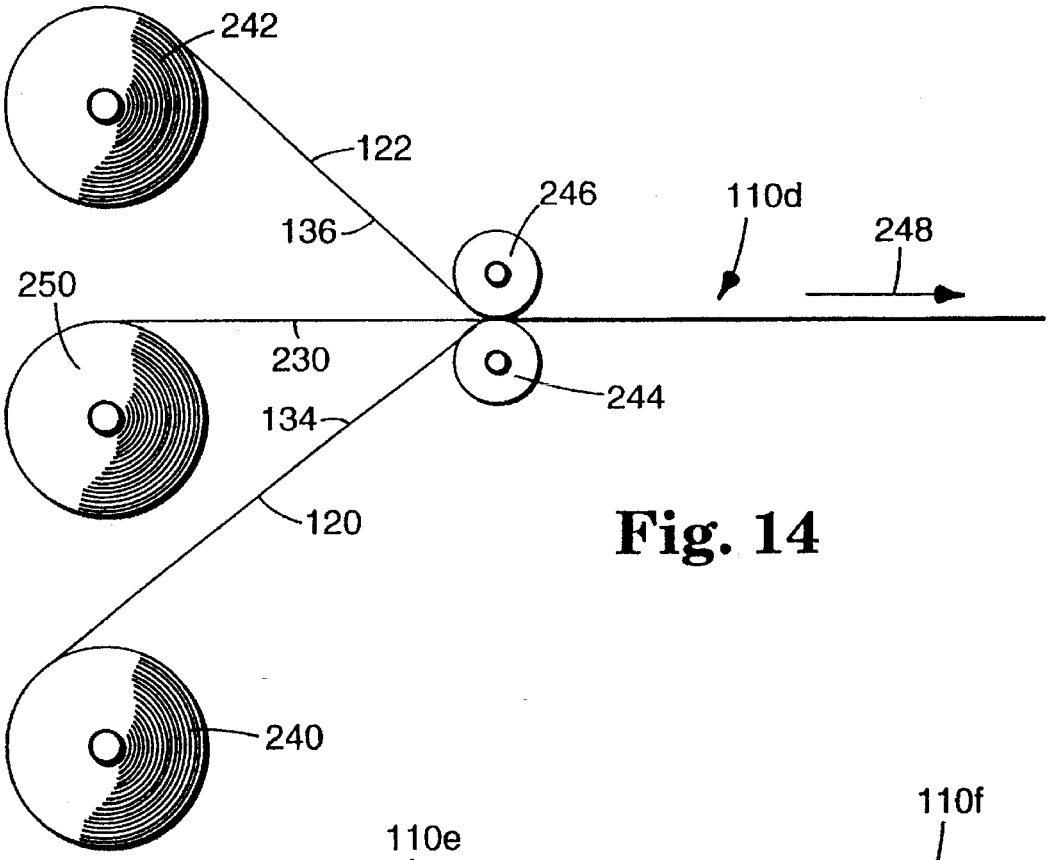
FIG. 14 is a schematic representation of an apparatus for forming the drawstrings of the alternate embodiment of the present invention shown in FIG. 13.

FIG. 14 illustrates one embodiment of apparatus and a method for constructing the prefabricated self-forming self-adhering pull bow of FIG. 13 and includes supply rolls 240 and 242 for drawstring webs 120 and 122, respectively. The drawstring webs pass through nip rollers 244 and 246 and the pressure sensitive adhesive layers 134,136 are reciprocally adhered and conveyed in direction 248. Release liner web 230 is conveyed from supply roll 250 to nip rollers 244 and 246 in between drawstring webs 120,122 to form a laminate that is conveyed in direction 248 and ultimately utilized to construct the prefabricated self-forming self-adhering pull bow 110*d* in a manner previously herein described.

In yet another alternate embodiment of the invention 110*e* shown in FIG. 15, one of the drawstrings 122 may be constructed with a length greater than the length of the other drawstring 120, so that the respective ends 138 are not aligned. The exposed length (as at 260) of the longer drawstring 122 may be coated, uncoated with pressure sensitive adhesive, or alternately, the exposed pressure sensitive adhesive of the longer drawstring may be covered with a removable release liner (not shown) prior to use.

Figure 16:
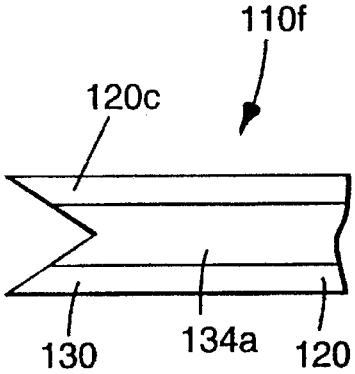
FIG. 16 is a magnified partial view of the drawstrings of yet another alternate embodiment of the present invention, wherein the layer of pressure sensitive adhesive is coated in a strip with a width narrower than the width of the drawstrings.

FIG. 16 illustrates yet another alternate embodiment of the separating means of the present invention, in which the layer of pressure sensitive adhesive is coated in a longitudinal strip having a width less than the width of the drawstrings. This ensures that at least a portion of the facing surfaces of the drawstrings will not be adhered to each other. These non-adhered portions may be grasped and pulled apart to separate the drawstrings. Preferably, the longitudinal strip is medially located to provide parallel laterally spaced non-adhered longitudinal side edges for the drawstrings.

Figure 17:
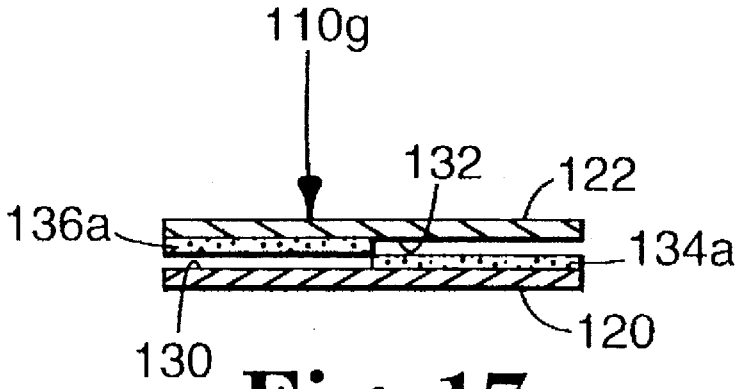
FIG. 17 is a magnified partial cross-sectional view of the drawstrings of another alternate embodiment of the present invention, wherein the layers of pressure sensitive adhesive are coated on offset portions of the facing surfaces of the drawstrings.

FIG. 17 illustrates another alternate embodiment of the present invention 110*g* in which the facing surfaces 130, 132 of the drawstrings 120,122 are coated with layers 134*a*, 136*a* of pressure sensitive adhesive on offset portions. That is, the layers 134*a*, 136*a* of pressure sensitive adhesive will not be in adhesive to adhesive contact when the drawstrings are brought together. Rather, the layers of pressure sensitive adhesive will adhere to an uncoated portion of the facing surface of the opposing drawstring. In the illustrated embodiment, the coated portions of the facing surfaces of the drawstrings are longitudinally extending strips on alternating sides of the drawstrings.

One of the advantages of the embodiment shown in FIG. 17 is that any suitable pressure sensitive adhesive may be employed, since the layers of pressure sensitive adhesive are not in direct contact. Further, suitable low adhesion coatings may be applied to the opposing portions of the drawstrings to limit the force required to separate the drawstrings to a desired level, yet provide a pressure sensitive adhesive that strongly adheres to surface to which the bow is applied.

The present invention has now been described with reference to multiple embodiments thereof. It will be apparent to those skilled in the art that many changes can be made in the embodiments described without departing from the scope of the present invention. For instance, in any of the above embodiments, a portion of the facing surfaces of the drawstrings may rendered non-adhesive by applying a layer of a masking material, as is known in the art, over portions of the drawstring that has been previously coated with a pressure sensitive adhesive. The masking material may take the form of a sheet of material or a liquid material that solidifies after application. Further, although it has been demonstrated that it is possible to heat bond and ultrasonic weld the drawstrings to each other through facing layers of pressure sensitive adhesive, it may be desirable to pattern coat the pressure sensitive adhesive on the drawstrings so that longitudinally spaced portions remain free of adhesive. The adhesive free portions would be aligned such as at the location 124 where the drawstrings and ribbon bands are bonded to each other. Thus, the scope of the present invention should not be limited to the structures described in this application, but only by structures described by the language of the claims and the equivalents of those structures.

What is claimed is:

1. A method for constructing a self-forming self-adhering pull bow for application to an object, comprising the steps of:

(a) providing a pair of ribbon band segments, each having a first width, a major surface, a first end and a second end;

(b) providing a pair of drawstrings, each having a second width less than the first width, a major surface, a first end and a second end, with at least a portion of the major surfaces of the drawstrings being coated with a pressure sensitive adhesive;

(c) aligning the pressure sensitive adhesive coated major surfaces of the drawstrings;

(d) adhering the drawstrings to each other by placing the pressure sensitive adhesive layers in contact with each other;

(e) aligning the major surfaces of the ribbon bands;

(f) interposing the reciprocally adhered drawstrings between the aligned ribbon bands;

(g) bonding the first ends of the drawstrings and the ribbon bands together; and (h) bonding the ribbon bands together in paired locations on opposite sides of the drawstrings to form fold lines.

2. The method of claim 1, further including the steps of:

(i) forming loops in the ribbon bands between the fold lines by shifting the second ends of the ribbon bands adjacent the first ends of the ribbon bands, thereby collecting the fold lines adjacent the first ends of the ribbon bands and forming the bow;

(j) separating the pressure sensitive adhesive coated surfaces of the drawstrings; and (k) applying the pressure sensitive adhesive coated surfaces of the separated drawstrings to an object to adhere the bow to the object.

3. The method of claim 2, wherein said pressure sensitive adhesive is a repositionable pressure sensitive adhesive, and further including the step of (l) removing the drawstrings from the object without damage to the object or to the bow.

4. The method of claim 3, further including the steps of:

(m) repositioning the bow with respect to the object; and (n) readhering the drawstrings of the bow to the object.

5. The method of claim 2, wherein step (d) includes the step of: forming a transverse weakened line in one of the reciprocally adhered drawstrings adjacent the second end thereof; and wherein step (j) includes the step of separating the drawstring at the weakened line to facilitate the separation of the drawstrings.

6. The method of claim 5, wherein the step of forming the weakened line includes the step of transversely cutting the one drawstring, with the segments of the drawstring being adhered to and supported by the other drawstring.

7. The method of claim 1, wherein step (d) includes the step of: forming a loop in one of the drawstrings prior to reciprocally adhering the drawstrings together to facilitate the separation of the drawstrings.

8. The method of claim 1, wherein step (d) includes the step of: interposing a tab between said drawstrings prior to reciprocally adhering the drawstrings together, with a portion of the tab projecting beyond the reciprocally adhered drawstrings to facilitate the separation of the drawstrings.

9. The method of claim 1, wherein step (d) includes the step of: interposing a release liner between said drawstrings prior to reciprocally adhering the drawstrings together to facilitate the separation of the drawstrings.

10. The method of claim 1, wherein step (b) includes the step of: providing one of the drawstrings with a length greater than the length of the other drawstring, whereupon adhering the drawstrings to each other in step (d) the second end of the longer drawstring projects beyond the second end of the other drawstring, to facilitate the separation of the drawstrings.

* * * * *